United States Patent [19]

Shepherd

[11] 4,360,336

[45] Nov. 23, 1982

[54] COMBUSTION CONTROL SYSTEM

[75] Inventor: Stanley H. Shepherd, Milpitas, Calif.

[73] Assignee: Econics Corporation, Sunnyvale, Calif.

[21] Appl. No.: 203,035

[22] Filed: Nov. 3, 1980

[51] Int. Cl.[3] ..... F23N 3/00

[52] U.S. Cl. ..... 431/12; 431/76; 236/15 E

[58] Field of Search ..... 431/10, 12, 76, 2; 236/15 E

[56] References Cited

U.S. PATENT DOCUMENTS

| | | | |
|---|---|---|---|
| 3,153,587 | 10/1964 | Schuerger | 431/76 |
| 3,184,686 | 5/1965 | Stanton | 236/15 E |
| 3,602,487 | 8/1971 | Johnson | 431/76 |
| 3,723,047 | 3/1973 | de Livois | 431/76 |
| 3,877,636 | 4/1975 | Sato | 236/14 |

FOREIGN PATENT DOCUMENTS

| | | | |
|---|---|---|---|
| 613164 | 6/1978 | U.S.S.R. | 431/76 |

OTHER PUBLICATIONS

*Computer Control in Process Industries,* E. I. Lowe and A. E. Hidden, Peter Peregrinus Ltd., London, 1971, pp. 24–26.

*Computer Control of Industrial Processes,* E. S. Savas, McGraw-Hill Book Co., 1965, p. 278.

*Primary Examiner*—James C. Yeung
*Assistant Examiner*—Lee E. Barrett
*Attorney, Agent, or Firm*—Townsend and Townsend

[57] ABSTRACT

A combustion control system which utilizes non-linear parameters for controlling a combustion process with greater efficiency than has heretofore been available is disclosed. According to the method, the quantity of carbon monoxide, unburned hydrocarbons, and/or opacity is measured and compared with a predetermined value for that parameter. Error signals for each parameter are generated and supplied to an error selector which chooses the error signal of the largest magnitude. The error signal is then compensated for the non-linear relationship between the parameter and the amount of excess air supplied to the combustion process. Other operations, including checking the proposed control signal output against one or more constraints are performed, and if satisfactory, an output signal is supplied to a servo-mechanism for controlling the air flow to the combustion process.

30 Claims, 1 Drawing Figure

COMBUSTION CONTROL SYSTEM

BACKGROUND OF THE INVENTION

1. Field of the Invention

This invention relates to a method and apparatus for improving the efficiency of a combustion process, and in particular, to a method and apparatus for controlling the combustion process based upon the level of carbon monoxide, opacity and/or unburned hydrocarbons in the exhaust gases.

2. Prior Art

Industrial and commercial facilities throughout the world utilize fossil fuel combustion processes to generate heat. The heat may be used in many different ways, for example, in drying, power generation, space heating, thermal processing of materials, etc. One known use of fossil fuels is to fire boilers for the generation of steam. Boilers produce steam by mixing fuel with air and burning the mixture in a combustion chamber. The heat generated is recovered by passing water through tubes in the boiler to generate steam. Burning the fuel-air mixture in effect combines oxygen in the air with the hydrogen and carbon in the fuel to form water vapor, carbon monoxide, carbon dioxide, and other products.

The efficiency of energy recovery when fossil fuels are burned in steam boilers typically ranges from 70 to 80%, depending upon the characteristics of the fuel burned, the condition of the boiler, and other variables. Most of the lost energy is heat generated by the combustion process which heat is not transferred to the steam but instead raises the temperature of the exhaust gases vented to the atmosphere by a smokestack.

Almost all equipment within which combustion processes are carried out is operated with "excess" air, that is, an amount of air that supplies more oxygen than is theoretically required to burn completely all of the hydrogen and carbon in the hydrocarbon fuel. Supplying a combustion process with excess air prevents loss of unburned fuel in the smokestack, and prevents potentially explosive mixtures of fuel and air. Because air contains only about 20% oxygen, the heating of the remaining 80% of the air, primarily nitrogen, from ambient temperature to the stack exhaust temperature is a major energy loss. Each percent of energy savings by reducing the amount of air heated to the typically 400°-600° F. stack exhaust temperature will save a percent of fuel, hence the desirability of minimizing the amount of excess air.

The traditional technique for determining and controlling the amount of excess air introduced with fuel to a combustion process has been to measure and control the amount of excess oxygen present in the smokestack exhaust gases. The basis for this practice has been the fundamentally correct understanding that the presence of oxygen in the exhaust gases indicates that more than an adequate supply of oxygen has been supplied for the fuel being burned. It is known, however, that the amount of excess air required to burn hydrocarbon fuel completely varies widely, from about 5 to 60 percent, depending upon the type and quality of the fuel burned, the condition of the boiler, and the load on the boiler. The wide variation in excess oxygen required mandates operation of a boiler at the high end of that particular boiler's range of excess air to avoid even occasional operation in a hazardous condition or in violation of pollution control requirements.

In the burning of hydrocarbons, hydrogen atoms are first split from the hydrocarbon molecule and then oxidized to form water vapor. Next, carbon atoms are oxidized to create carbon monoxide, and the carbon monoxide oxidized to create carbon dioxide. It is known that the level of carbon monoxide in the exhaust gas from a combustion process provides a measure of the completeness of combustion. It is also known that carbon monoxide levels, as a function of excess air, decrease rapidly up to a minimum level of excess air, and then remain relatively constant as additional excess air is supplied.

Unfortunately, control of a combustion process cannot be predicated solely upon the quantity of carbon monoxide present because other limitations may require a higher level of excess air than the carbon monoxide level alone. For example in oil or coal-fired boilers, the boiler may begin to smoke before the desired minimum carbon monoxide level is reached. Similarly, other variables, such as the presence of hydrocarbons in the exhaust gases or the temperature of the exhaust gases may limit the amount of excess air necessary for the combustion process. Therefore, control of a combustion process cannot be based upon a single variable such as carbon monoxide, but must take into account other potentially limiting variables.

Prior art devices which have attempted to rely upon more than one variable in controlling a combustion process have suffered from a number of disadvantages. In some devices, undesirable oscillations in control inputs occur. These oscillations may create thermal stresses which can damage the boiler or other vessel in which the combustion is occurring. In yet other systems existing control elements such as fuel flow valves, fan dampers, and feed water valves, must be replaced with electronically controllable servomechanisms, thereby undesirably increasing the costs of such an installation.

Examples of prior combustion control devices and methods which rely at least partially upon measuring the level of carbon monoxide in the exhaust gases include U.S. Pat. No. 3,723,047 issued to Baudelet de Livois. That patent discloses a control network for a combustion process in which properties of the exhaust gases are sensed and used to control the combustion process.

SUMMARY OF THE INVENTION

This invention provides a method and apparatus for controlling a combustion process which overcomes disadvantages of previous techniques. According to one embodiment of the invention a method of controlling a combustion process includes the steps of detecting the quantity of at least one of the three parameters chosen from the group consisting of carbon monoxide, opacity, and unburned hydrocarbons in the exhaust gases; comparing the quantity of each parameter chosen with a predetermined quantity for that parameter to thereby generate an error signal for the parameter, the error signal for the chosen parameter being negative when the quantity of the parameter detected is greater than the predetermined quantity; adjusting the most negative error signal generated for the non-linear relationship between the parameter from which the error signal was generated and air supplied to the combustion process to thereby generate a corrected error signal; and supplying the corrected error signal to the control apparatus to thereby vary the amount of air supplied to the combustion process.

Apparatus for controlling the combustion process in accordance with the above described method includes: parameter input means for specifying a desired level of at least one of three parameters chosen from the group consisting of carbon monoxide, opacity, and unburned hydrocarbons in the exhaust gases; parameter sensor means for detecting the quantity of each chosen parameter in the exhaust gases and supplying a corresponding parameter output signal in response; signal processing means connected to the parameter sensor means and connected to the parameter input means for comparing the parameter sensor output signal of each chosen parameter with the corresponding desired level for that parameter, and in response thereto producing a combustion correction control signal; and control signal output means connected to receive the combustion correction control signal and supply a control signal to change the ratio of fuel and air in the combustion process.

According to a further embodiment of the invention, a method of controlling a combustion process which produces exhaust gases includes the steps of detecting the quantity of carbon monoxide in the exhaust gases; detecting at least one parameter taken from the group consisting of unburned hydrocarbons, oxygen, temperature, and opacity of the exhaust gases; comparing the quantity of carbon monoxide in the exhaust gases with a predetermined quantity of carbon monoxide to thereby derive an error signal; adjusting the error signal to compensate for at least the nonlinear relationship between air/fuel ratio and carbon monoxide to thereby derive a correction signal; comparing the at least one parameter taken from the above group with a predetermined maximum value for that parameter; and supplying the correction signal to a control apparatus if the at least one parameter is less than the predetermined maximum value.

In a preferred embodiment the combustion control system operates by measuring the quantity of at least two of the three parameters carbon monoxide, unburned hydrocarbons, and opacity, and generating an error signal for the single parameter most above (or least below) the target level for that parameter, compensating the error signal for the non-linear relationship between that parameter and excess air in the combustion process, and supplying the compensated error signal to a constraint comparator. The constraint comparator checks the temperature and/or oxygen content of the exhaust gases and allows the compensated error signal to be supplied to a servomechanism only if neither temperature nor oxygen have exceeded the preselected limits.

In some embodiments, apparatus is included for filtering the signals from the apparatus which measures the quantity of the parameters in the exhaust gases. In further embodiments, apparatus is provided to delay the control signal for a selected time to allow the effect of any previous control signals to pass completely through the system.

DETAILED DESCRIPTION

Figure 1:
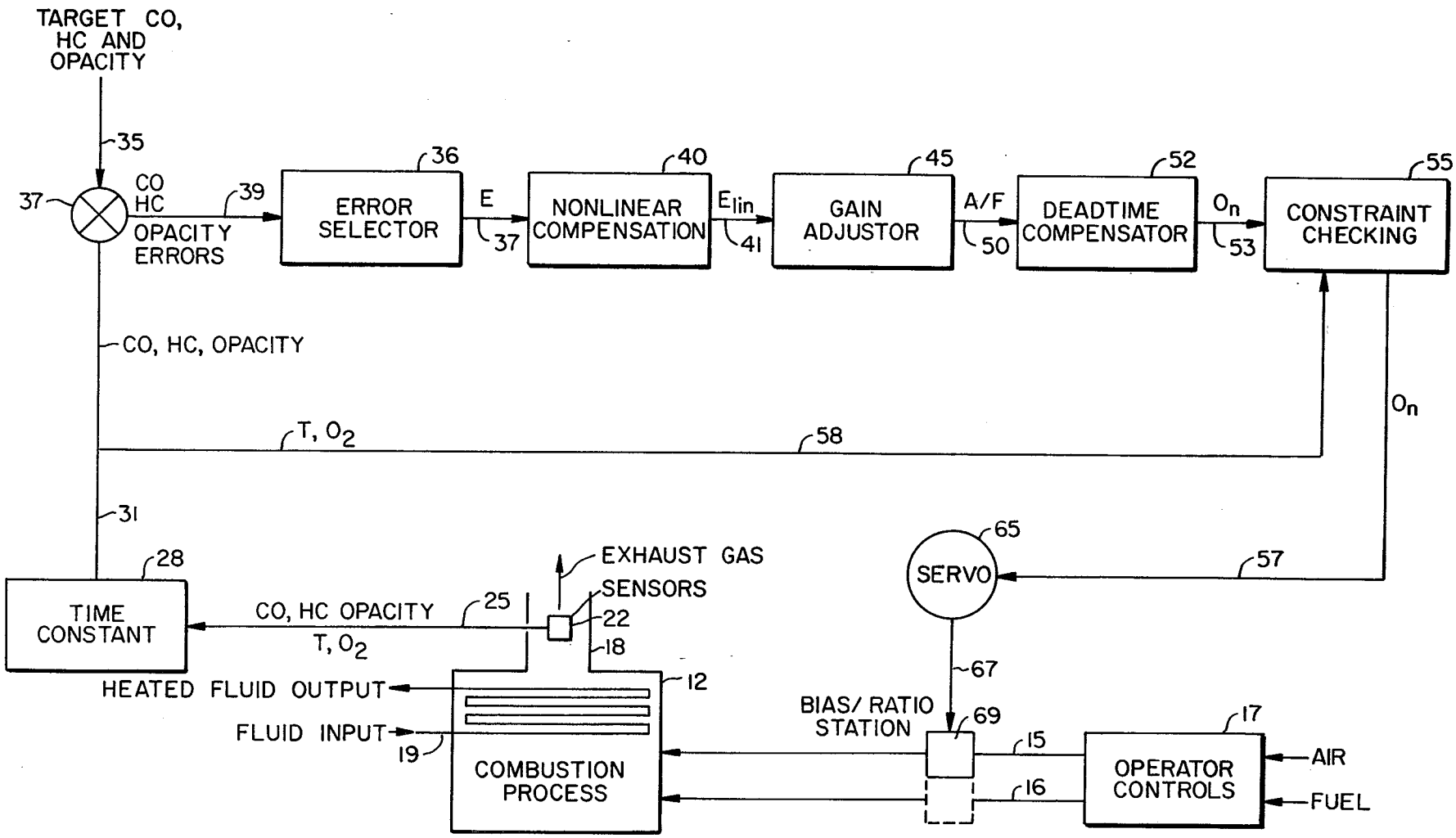
FIG. 1 is a schematic drawing showing one embodiment of the process and apparatus of the invention.

One embodiment of the combustion control system of this invention which allows more efficient control of a combustion process is shown in FIG. 1. As depicted, a combustion process occurs within vessel 12 which may be a boiler or other known apparatus. The process shown is used to add heat to fluid supplied through tubing 19. Air and fuel are supplied to the combustion process via lines 15 and 16 which may be pipelines, or other known air and fuel transport devices. The quantity of air and fuel supplies is primarily controlled by operator controls 17. The particular settings of controls 17 will depend primarily upon the quantity of heat desired to be supplied by process 12 to the fluid in tubes 19. Typically, the air and fuel are mixed together within vessel 12 and then ignited. The heat generated by the chemical reaction between the fuel and air is transferred to a chosen material flowing through the boiler in tubes 19, to a heat exchanger, or by other known radiant, conductive, or convective means. The combustion products including unburned hydrocarbons, carbon dioxide, carbon monoxide, ash, and other materials or gases are emitted from the process vessel 12 via stack 18 after passing one or more sensors 22.

Sensors 22 may comprise a plurality of known sensors, one for detecting each constituent in the exhaust gases desired to be measured. In the preferred embodiment, sensor 22 is constructed according to the techniques set forth in U.S. Pat. Nos. 4,205,550, 4,206,630 and Ser. No. 070,744 filed Aug. 29, 1979. These patents describe one technique for fabricating a purge tube apparatus and associated sensor for measuring carbon monoxide, unburned hydrocarbons and the opacity of the exhaust gases. In some embodiments of the invention a sensor will also be provided to detect oxygen, and exhaust gas temperature. The output signal from the one or more sensors 22 is supplied via line 25, typically a coaxial cable or other electrical connector to an apparatus 28 which filters the sensor output signals. Filter 28 removes high frequency noise from the signals on line 25. In one embodiment filter 25 comprises an exponential filter applied to each sensor output signal according to the equation:

$$V' = V'(\text{previous}) \cdot F + V \cdot (1 - F)$$

where V′ is the filtered value of the measurement, V is the unfiltered measurement, and F is a filter factor having a value between 0 and 1. For most analog inputs the filter factor F is set at 0.75, which corresponds to an exponential time constant of about 8 seconds. Typically the filter factor is switch adjustable from 0 to 0.99 to enable adjustment of the filter factor depending upon the particular combustion process and equipment involved.

In the preferred embodiment a measured value for the quantity of carbon monoxide, unburned hydrocarbons, and opacity is supplied approximately every 2 seconds to filter 28, and from filter 28 over line 31 to comparator 37. Comparator 37, which may be fabricated in any known manner, also accepts as an input signal a target value for the quantities of carbon monoxide, unburned hydrocarbons and opacity. Comparator 37 generates as an output signal a plurality of error signals on one or more lines 39. In some embodiments the output signals from the comparator are multiplexed over a single line. The error signal is typically computed by subtracting the measured value of a parameter from the target level for that parameter. An error signal so computed is referred to herein as a negative error when the measured value is above the target level.

The resulting error signal or signals are supplied to an error selector 36 which chooses the most negative error (or least positive, if all errors are positive) and supplies that signal E via line 37 to non-linear compensation apparatus 40. This apparatus compensates for the non-linear relationship between the parameter for which the error signal is being supplied and the air/fuel ratio being supplied to combustion process 12.

Because carbon monoxide, opacity, or unburned hydrocarbons are non-linear as a function of air/fuel ratio, a linear control system would have either too high a process gain at low measured parameter levels or too low a process gain at high measured parameter levels. Too high a process gain results in very sluggish response to large amounts of excess air, while too low a process gain creates a jittery control system with a tendency to overshoot the target. In one embodiment of the invention when a carbon monoxide error signal is supplied on line 41 from non-linear compensator 40, the actual error signal itself is supplied if the carbon monoxide level is greater than 120 parts per million. If the carbon monoxide level CO is less than or equal to 120 parts per million, the signal on line 40 is defined by the following relationship:

$$E_{lin}=E\cdot(170-CO)/50$$

If another parameter has generated the most negative error signal, that parameter may be similarly processed to compensate for non-linearities.

After compensation of the error signal for the non-linearities as described above, the linearized error signal $E_{lin}$ is supplied on line 41 to a gain adjustment apparatus 45. Apparatus 45 scales the error correction signal to the appropriate size depending upon the unit 12 used for containing the combustion process. The gain will depend primarily upon the manner in which the control system is connected to the existing combustion process operation and may be expressed as:

$$A/F=E_{lin}/G$$

where A/F is the air/fuel ratio error and G is the process gain. The overall process gain G is defined using, for example, units of parts per million carbon monoxide per second of control output or other units suitable to other parameters. The gain is determined by empirical tests during installation of the control system. Once the tests are complete the process gain will usually be set using switches on the control apparatus.

The air/fuel ratio error is supplied on line 50 to dead-time compensation apparatus 52. The purpose of dead-time compensation apparatus 52 is to allow time for the combustion process to respond to previous control inputs before making further control inputs. This is accomplished by processing the air/fuel ratio signal on incoming line 50 according to the following equation:

$$O_n=Q\cdot[(1-L)/L]\delta(A/F)+(A/F)_n$$

where $O_n$ is the output signal from apparatus 52 at a given time n, $(A/F)_n$ is the input (or control error) at time n, $\delta(A/F)$ is the change in error between time n and time n−1, Q is a function of the closed-loop time constant and L is a function of the first-order lag time constant. The factor Q is empirically selected to slow the overall control system response sufficiently to provide a stable output signal. The term (1−L)/L provides a lead time for the A/F signal to compensate for the first-order lag of the combustion process.

To permit rapid responses to upsets in the combustion process, in some embodiments an additional term may be added to the right-hand side of the above equation in which all incremental control moves that have been made too recently to have any effect on the output signal from sensor 22 are removed from the equation. This factor may also be determined empirically and set using switches.

The output signal $O_n$ from the dead time compensator 52 is supplied on line 53 to be checked against certain constraints. As shown in FIG. 1, other variables measured by the one or more sensors 22 are supplied to the constraint comparison apparatus 55 via line 58. The purpose of the constraint comparison apparatus 55 is to confirm before making any control movement based upon the output $O_n$ on line 53 that none of the constraints, for example, oxygen level and stack temperature, have already been reached or exceeded. Thus the measured values on line 58 are compared to previously stored values in constraint comparison apparatus 55. If none of the constraints has reached its limit, then the output signal $O_n$ is supplied on line 57 to servo 65. If a constraint has been reached or exceeded, then the constraint comparison apparatus 55 ignores the control movement $O_n$ supplied on line 53 and instead supplies increased air to the combustion process 12. The amount of increased air supplied will also be determined by a switch setting determined empirically in conjunction with each application of the system shown in FIG. 1.

The particular setting of each constraint will depend upon empirical tests performed at the particular combustion apparatus on which the control system shown in FIG. 1 is installed. For example, the temperature constraint will typically depend upon the sulfur content of the fuel. If the temperature constraint is set too low sulfuric acid may be a byproduct of the combustion process and will damage the combustion apparatus 15. Typically the temperature constraint will be approximately 300° F. The opacity, if not a measured parameter, may be a constraint used primarily in conjunction with oil or coal-fired boilers. Opacity is empirically determined for each installation to maintain the operation of that installation within any pollution control requirements applicable. Similarly, a constraint on unburned hydrocarbons may be empirically determined, if not already used as a measured parameter. The constraint is typically on the order of 500 parts per million. The oxygen levels are also set empirically, being typically approximately 0.5% below any existing oxygen level setting at a combustion apparatus.

The output signal $O_n$ on line 57 causes servomechanism 65 to perform an appropriate mechanical, electrical, pneumatic, or other known control operation via line 67 to the bias ratio station 69. The bias ratio station 69 accumulates the output adjustments from servo 65 on line 67. As shown in FIG. 1 the operator controls 17 have been used to preselect the initial amount of air and fuel supplied via lines 15 and 16 to the combustion process. Thus the bias ratio station in effect fine tunes the quantity of air or fuel supplied to the combustion process. Because the bias ratio station is typically applied only to the air line, only a dashed line is shown interrupting the fuel flow line 16.

As described the invention provides a combustion control system resulting in greater thermodynamic efficiency. The apparatus interfaces to existing combustion control systems in a manner which is minimally intrusive, and which if disabled results in an inherently safe system remaining under existing operator control.

The combustion control system is based upon measurement of many of the flue gas constituents that may limit reduction of excess air flow. The exhaust gas from the combustion process may be analyzed as frequently as desired, and the output supplied to the apparatus of this invention. The control strategy may be based upon carbon monoxide concentration and one or more other constituents or properties of the exhaust gas. Because the control signal from the apparatus of the invention acts to bias an existing control input, rather than to provide an absolute setting for that control input, any previous control strategies with regard to controlling air or fuel flow as a function of boiler output desired, or other factors, remain intact.

Although the invention has been described in conjunction with reference to a specific embodiment, the description is intended to be illustrative of the invention and is not to be construed as limiting it. Various modifications and applications may occur to those skilled in the art without departing from the true spirit and scope of the invention as defined by the appended claims.

What is claimed is:

1. A method of controlling a combustion process producing exhaust gases and having a non-linear relationship between each of carbon monoxide, unburned hydrocarbons, and opacity with respect to air supplied, the method comprising:

detecting the quantity of at least two of three parameter chosen from the group consisting of carbon monoxide, opacity, and unburned hydrocarbons in the exhaust gases;

subtracting the quantity of each detected parameter from a predetermined quantity for that parameter to thereby derive an error signal for the parameter;

selecting the most negative of the error signals generated;

adjusting the selected error signal for the non-linear relationship between the parameter from which the error signal was generated and the air supplied to the combustion process to thereby generate a corrected error signal;

supplying the corrected error signal to a control apparatus to vary the amount of air supplied to the combustion process;

detecting the quantity of at least one of two constraints chosen from the group consisting of oxygen and exhaust gas temperature; and comparing the quantity of the constraint detected with a predetermined quantity for at least one of the constraints to thereby prevent supplying the corrected error signal to the control apparatus if the quantity detected is not less than the predetermined quantity.

2. A method as in claim 1 including the step of further adjusting the selected error signal to compensate for a time delay in the response of the combustion process to any previously supplied correction signal.

3. A method as in claim 2 wherein the step of further adjusting is performed after the step of adjusting.

4. A method as in claim 1 wherein the step of detecting the quantity produces an electrical signal for each parameter chosen.

5. A method as in claim 4 including the step of filtering each electrical signal to remove noise prior to the step of comparing the quantity.

6. A method as in claim 1 wherein the control apparatus includes a characteristic gain and the method includes a step of also adjusting the error signal to compensate for the characteristic gain of the control apparatus.

7. A method as in claim 1 wherein the step of detecting the quantity includes detecting the quantity of carbon monoxide.

8. A method as in claim 7 wherein the quantity of carbon monoxide in the exhaust gases is maintained at a lower level than the predetermined quantity of carbon monoxide.

9. A method as in claim 8 wherein the error signal is a measure of how much less air should be supplied to the combustion process to achieve the predetermined quantity of carbon monoxide.

10. A method as in claim 9 wherein additional air is supplied to the combustion process if at least one parameter is not less than the predetermined maximum value for that parameter.

11. A method as in claim 7 including the step of further adjusting the error signal to compensate for a time delay in the response of the combustion process to any previously supplied correction signal.

12. A method as in claim 11 wherein the step of further adjusting is performed following the step of adjusting.

13. A method as in claim 7 wherein the step of detecting the quantity of carbon monoxide produces a first electrical signal.

14. A method as in claim 13 including the step of filtering the first electrical signal prior to the step of comparing the quantity of carbon monoxide in the exhaust gases.

15. A method as in claim 14 wherein the step of filtering comprises applying an exponential filter.

16. A method as in claim 7 wherein the control apparatus includes a gain characteristic, the method including the step of also adjusting the error signal to compensate for the gain characteristic of the control apparatus.

17. A method as in claim 16 wherein the step of also adjusting the error signal follows the step of adjusting the error signal.

18. A method as in claim 7 wherein the step of detecting the quantity of carbon monoxide and the step of detecting at least one other parameter are performed simultaneously.

19. A method of controlling a combustion process producing exhaust gases, the combustion process having a non-linear relationship between air/fuel ratio and each of carbon monoxide, opacity and unburned hydrocarbons, the method comprising:

detecting the quantity of each of the parameters carbon monoxide, opacity, and unburned hydrocarbons in the exhaust gases;

sensing at least one of the quantity of oxygen and the temperature of the exhaust gases;

comparing the quantity of each parameter detected in the exhaust gases with a predetermined quantity for each parameter to thereby derive an error signal for each parameter;

selecting one of the derived error signals;

non-linear compensating the selected error signal to compensate for at least the non-linear relationship;

time compensating the selected error signal to compensate for a time delay in the response of the combustion process;

gain compensating the selected error signal to compensate for the gain characteristic of the control apparatus;

comparing the at least one parameter sensed with a predetermined maximum value for that parameter; and supplying the non-linear, time, and gain compensated selected error signal to a control apparatus if the at least one parameter sensed is less than the predetermined maximum value for that parameter.

20. Apparatus for controlling a combustion process in which fuel and air are mixed in a ratio and burned producing exhaust gases, the apparatus comprising:

parameter input means for specifying a desired quantity of at least 2 of the parameters chosen from the group consisting of carbon monoxide, opacity, and unburned hydrocarbons in the exhaust gases;

constraint input means for specifying a desired quantity of at least one of the contraints chosen from the group consisting of the quantity of oxygen and the exhaust gas temperature;

parameter sensor means for detecting the quantity of each chosen parameter and supplying a respective parameter sensor signal for each chosen parameter;

constraint sensor means for detecting the quantity of each chosen constraint and supplying a respective constraint sensor signal for each chosen constraint;

parameter signal processing means connected to the parameter input means and connected to the parameter sensor means for comparing the detected quantity of each chosen parameter with the specified quantity of that parameter and supplying a respective parameter error signal in response;

constraint signal processing means connected to the constraint input means and connected to the constraint sensor means for comparing the detected quantity of each chosen constraint with the specified quantity of that constraint and supplying a constraint error signal if the detected quantity is not less than the specified quantity;

error signal selection means for selecting one of the parameter error signals supplied; and control signal output means connected to receive the selected parameter error signal and the constraint error signal and for supplying a control signal to change the ratio of fuel and air.

21. Apparatus as in claim 20 further including filter means connected to receive the signals from both the parameter sensor means and the constraint sensor means for removing at least part of any noise from said signals.

22. Apparatus as in claim 21 wherein the filtering means comprises an exponential filter.

23. Apparatus as in claim 20 further including signal adjustment means connected between the parameter signal processing means and the control signal output means for adjusting the combustion control signal for any non-linear relationship between the detected parameter and the ratio of fuel and air supplied to the combustion process.

24. Apparatus as in claim 20 further including time delay means for delaying for a selected time the control signal to change the ratio of fuel and air.

25. Apparatus as in claim 24 wherein the selected time is at least long enough to allow any previously supplied control signal to have caused the change in the ratio of fuel and air to be detected by the parameter sensor means.

26. Apparatus as in claim 20 further including filter means connected to receive the signals from both the parameter means and the constraint sensor means for removing at least part of any noise from said signals.

27. Apparatus as in claim 26 wherein the filtering means comprises an exponential filter.

28. Apparatus as in claim 20 further including signal adjustment means connected between the parameter signal processing means and the control signal output means for adjusting the combustion control signal for any non-linear relationship between the detected parameters and the ratio of fuel and air supplied to the combustion process.

29. Apparatus as in claim 20 further including time delay means for delaying for a selected time the control signal to change the ratio of fuel and air.

30. Apparatus as in claim 29 wherein the selected time is at least long enough to allow any previously supplied control signal to have caused the change in the ratio of fuel and air to be detected by the parameter sensor means.

* * * * *